US009984643B2

(12) United States Patent
Ban et al.

(10) Patent No.: US 9,984,643 B2
(45) Date of Patent: May 29, 2018

(54) DATA DRIVER, DISPLAY APPARATUS HAVING THE SAME AND METHOD OF DRIVING THE DISPLAY APPARATUS

(71) Applicant: SAMSUNG DISPLAY CO., LTD., Yongin-si, Gyeonggi-do (KR)

(72) Inventors: Young-Il Ban, Hwaseong-si (KR); Sun-Koo Kang, Seoul (KR); Tae-Gon Kim, Busan (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 25 days.

(21) Appl. No.: 15/145,172

(22) Filed: May 3, 2016

(65) Prior Publication Data

US 2017/0004797 A1 Jan. 5, 2017

(30) Foreign Application Priority Data

Jul. 1, 2015 (KR) ..... 10-2015-0094216

(51) Int. Cl.
*G09G 3/36* (2006.01)

(52) U.S. Cl.
CPC ..... *G09G 3/3688* (2013.01); *G09G 3/3607* (2013.01); *G09G 2300/0452* (2013.01); *G09G 2310/027* (2013.01); *G09G 2320/0673* (2013.01)

(58) Field of Classification Search
CPC ..... G09G 3/3607; G09G 3/3688; G09G 2300/0452; G09G 2310/027; G09G 2320/0673
See application file for complete search history.

(56) References Cited

U.S. PATENT DOCUMENTS

2005/0207249 A1* 9/2005 Morita ..... G09G 3/3233 365/203
2007/0132695 A1* 6/2007 Kim ..... G09G 3/3611 345/98
2008/0198282 A1* 8/2008 Su ..... G09G 3/3648 349/37
2009/0153533 A1* 6/2009 Umeda ..... G09G 3/3607 345/204
2010/0085292 A1* 4/2010 Chen ..... G09G 3/3688 345/92
2014/0049713 A1* 2/2014 No ..... G02F 1/13306 349/41

FOREIGN PATENT DOCUMENTS

KR 10-2008-0000143 1/2008

* cited by examiner

*Primary Examiner* — Lixi C Simpson
(74) *Attorney, Agent, or Firm* — F. Chau & Associates, LLC

(57) ABSTRACT

A data driver includes a first data voltage generator, a data converter and a second data voltage generator. The first data voltage generator is configured to generate a first data voltage based on first pixel data and configured to output the first data voltage to a first data line, the first pixel data being generated based on a first gamma curve. The data converter is configured to convert second pixel data to first converted pixel data, the second pixel data being generated based on the first gamma curve, the first converted pixel data being generated based on a second gamma curve different from the first gamma curve. The second data voltage generator is configured to generate a second data voltage based on the first converted pixel data and configured to output the second data voltage to a second data line.

20 Claims, 4 Drawing Sheets

| GRAY | PD2 | CPD1 |
|---|---|---|
| 255 | 11111111 | 11111110 |
| 254 | 11111110 | 11111100 |
| ⋮ | ⋮ | ⋮ |

DATA DRIVER, DISPLAY APPARATUS HAVING THE SAME AND METHOD OF DRIVING THE DISPLAY APPARATUS

CROSS-REFERENCE TO RELATED APPLICATION

This application claims priority under 35 U.S.C. § 119 to Korean Patent Application No. 10-2015-0094216, filed on Jul. 1, 2015 in the Korean Intellectual Property Office (KIPO), the disclosure of which is incorporated by reference herein in its entirety.

1. Technical Field

Exemplary embodiments of the present inventive concept relate to a data driver, and more particularly to a display apparatus including the data driver and a method of driving the display apparatus.

2. Discussion of Related Art

A liquid crystal display (LCD) apparatus may include a first substrate including a pixel electrode, a second substrate including a common electrode, and a liquid crystal layer disposed between the first and second substrates. Voltages may be applied to the pixel electrode and the common electrode to generate an electric field. Transmittance of light passing through the liquid crystal layer may be controlled according to the electric field, and thus, a desired image may be displayed.

The LCD apparatus may be prone to side visibility deterioration as compared to front visibility presentation.

SUMMARY

Exemplary embodiments of the present inventive concept may provide a data driver having increased display quality.

Exemplary embodiments of the present inventive concept may provide a display apparatus including the data driver.

Exemplary embodiments of the present inventive concept may provide a method of driving the display apparatus.

A data driver according to an exemplary embodiment of the present inventive concept includes a first data voltage generator, a data converter and a second data voltage generator. The first data voltage generator is configured to generate a first data voltage based on first pixel data and configured to output the first data voltage to a first data line, the first pixel data being generated based on a first gamma curve. The data converter is configured to convert second pixel data to first converted pixel data, the second pixel data being generated based on the first gamma curve, the first converted pixel data being generated based on a second gamma curve different from the first gamma curve. The second data voltage generator is configured to generate a second data voltage based on the first converted pixel data and configured to output the second data voltage to a second data line.

In an exemplary embodiment of the present inventive concept, the data converter may access a look-up table configured to convert the second pixel data corresponding to a first gray to the first converted pixel data corresponding to the first gray.

In an exemplary embodiment of the present inventive concept, the first pixel data may be substantially the same as the second pixel data.

In an exemplary embodiment of the present inventive concept, a polarity of the first data voltage may be different from a polarity of the second data voltage.

In an exemplary embodiment of the present inventive concept, the first data line may be adjacent to the second data line.

In an exemplary embodiment of the present inventive concept, a composite gamma curve of the first and second gamma curves may be substantially the same as a reference gamma curve. A luminance of an image based on the first gamma curve may be equal to or higher than a luminance of an image based on the reference gamma curve, and a luminance of an image based on the second gamma curve may be equal to or lower than the luminance of the image based on the reference gamma curve.

A display apparatus according to an exemplary embodiment of the present inventive concept includes a display panel, a timing controller and a data driver. The display panel includes a first gate line extending in a first direction, first and second data lines extending in a second direction, and a first pixel connected to the first gate line and the first and second data lines, the second direction crossing the first direction. The timing controller is configured to generate first and second pixel data based on input image data and a first gamma curve. The data driver is configured to generate a first data voltage based on the first pixel data to output the first data voltage to the first data line, configured to convert the second pixel data to first converted pixel data, and configured to generate a second data voltage based on the first converted pixel data to output the second data voltage to the second data line, the first converted pixel data being generated based on a second gamma curve different from the first gamma curve.

In an exemplary embodiment of the present inventive concept, the first pixel may include a first sub-pixel connected to the first gate line and the first data line and a second sub-pixel connected to the first gate line and the second data line.

In an exemplary embodiment of the present inventive concept, the first sub-pixel may be configured to display substantially the same color as the second sub-pixel.

In an exemplary embodiment of the present inventive concept, the data driver may access a look-up table configured to convert the second pixel data corresponding to a first gray to the first converted pixel data corresponding to the first gray.

In an exemplary embodiment of the present inventive concept, the first pixel data may be substantially the same as the second pixel data.

In an exemplary embodiment of the present inventive concept, a polarity of the first data voltage may be different from a polarity of the second data voltage.

In an exemplary embodiment of the present inventive concept, the first data line may be adjacent to the second data line.

In an exemplary embodiment of the present inventive concept, a composite gamma curve of the first and second gamma curves may be substantially the same as a reference gamma curve. A luminance of an image based on the first gamma curve may be equal to or higher than a luminance of an image based on the reference gamma curve, and a luminance of an image based on the second gamma curve may be equal to or lower than the luminance of the image based on the reference gamma curve.

A method of driving a display apparatus according to an exemplary embodiment of the present inventive concept includes generating first and second pixel data based on input image data and a first gamma curve. A first data voltage is generated based on the first pixel data to output the first data voltage to a first data line. The second pixel data is converted to first converted pixel data, the first converted pixel data being generated based on a second gamma curve different from the first gamma curve. A second data voltage is generated based on the first converted pixel data to output the second data voltage to a second data line.

In an exemplary embodiment of the present inventive concept, the display apparatus may include a display panel including a first gate line extending in a first direction, the first and second data lines extending in a second direction, and a first pixel connected to the first gate line and the first and second data lines, the second direction crossing the first direction.

In an exemplary embodiment of the present inventive concept, the first pixel may include a first sub-pixel connected to the first gate line and the first data line and a second sub-pixel connected to the first gate line and the second data line.

In an exemplary embodiment of the present inventive concept, converting the second pixel data to first converted pixel data may include converting the second pixel data corresponding to a first gray to the first converted pixel data corresponding to the first gray.

In an exemplary embodiment of the present inventive concept, the first pixel data may be substantially the same as the second pixel data.

In an exemplary embodiment of the present inventive concept, a composite gamma curve of the first and second gamma curves may be substantially the same as a reference gamma curve. A luminance of an image based on the first gamma curve may be equal to or higher than a luminance of an image based on the reference gamma curve, and a luminance of an image based on the second gamma curve may be equal to or lower than the luminance of the image based on the reference gamma curve.

According to exemplary embodiments of the present inventive concept, images may be generated based on a plurality of gamma curves without increasing a size of a timing controller or a data driver.

BRIEF DESCRIPTION OF THE DRAWINGS

A more complete appreciation of the present inventive concept will become more apparent by describing in detail exemplary embodiments thereof with reference to the accompanying drawings, in which.

DETAILED DESCRIPTION OF EMBODIMENTS

Exemplary embodiments of the present inventive concept will be described in more detail below with reference to the accompanying drawings in which exemplary embodiments of the present inventive concept are shown.

Figure 1:
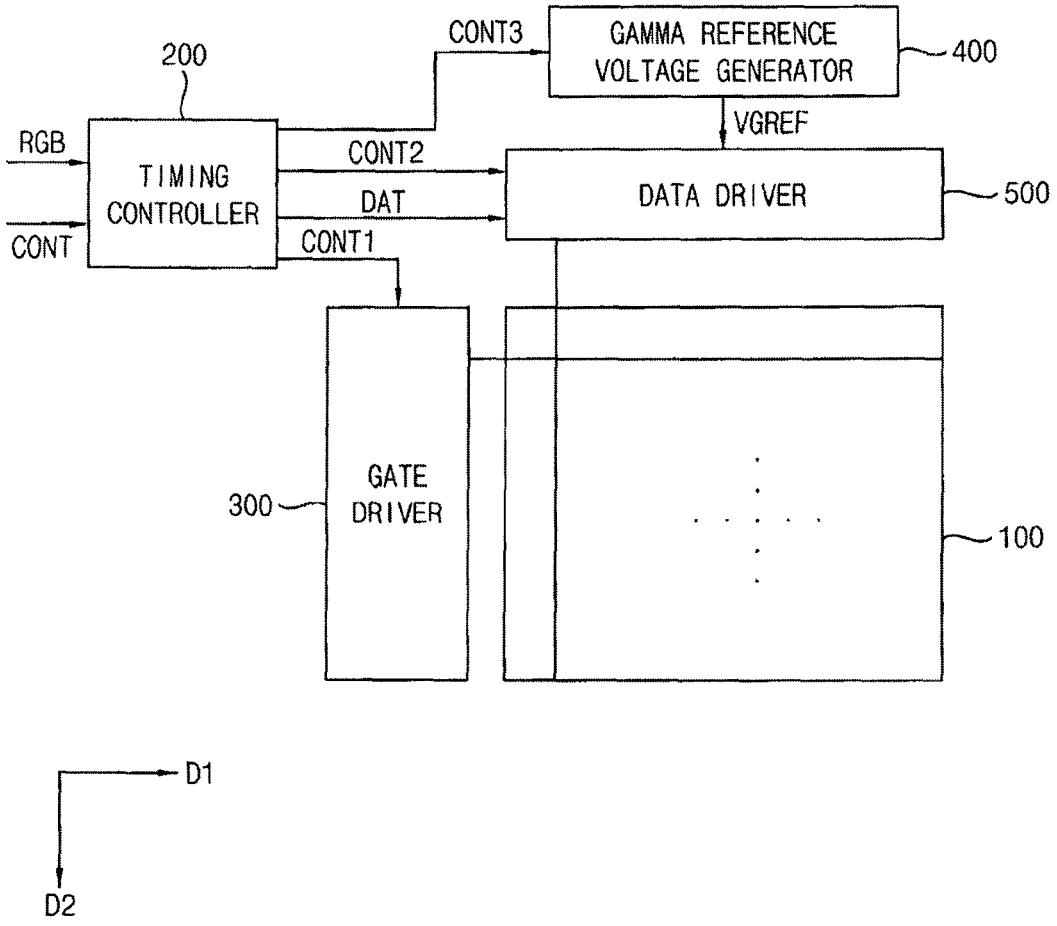
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, a display apparatus may include a display panel 100 and a panel driver. The panel driver may include a timing controller 200, a gate driver 300, a gamma reference voltage generator 400 and a data driver 500.

The display panel 100 may include a display region displaying an image and a peripheral region adjacent to the display region.

The display panel 100 may include a plurality of gate lines, a plurality of data lines and a plurality of pixels connected to the gate lines and the data lines. The gate lines may extend in a first direction D1 and the data lines may extend in a second direction D2 crossing the first direction D1.

In some exemplary embodiments of the present inventive concept, the pixels may include a switching element, a liquid crystal capacitor and a storage capacitor. The liquid crystal capacitor and the storage capacitor may be electrically connected to the switching element. The pixels may be arranged in a matrix configuration.

The display panel 100 will be described in more detail below with reference to FIG. 3.

The timing controller 200 may receive input image data RGB and an input control signal CONT from an external device. The input image data RGB may include red image data R, green image data G and blue image data B. The input control signal CONT may include a master clock signal and a data enable signal. The input control signal CONT may include a vertical synchronizing signal and a horizontal synchronizing signal.

The timing controller 200 may generate a first control signal CONT1, a second control signal CONT2, a third control signal CONT3 and a data signal DAT based on the input image data RGB and the input control signal CONT.

The timing controller 200 may generate the first control signal CONT1 controlling operations of the gate driver 300 based on the input control signal CONT, and may output the first control signal CONT1 to the gate driver 300. The first control signal CONT1 may include a vertical start signal and a gate clock signal.

The timing controller 200 may generate the second control signal CONT2 controlling operations of the data driver 500 based on the input control signal CONT, and may output the second control signal CONT2 to the data driver 500. The second control signal CONT2 may include a horizontal start signal and a load signal.

The timing controller 200 may generate the data signal DAT based on the input image data RGB and a first gamma curve. The timing controller 200 may output the data signal DAT to the data driver 500.

The first gamma curve will be described in more detail below with reference to FIG. 2.

The timing controller 200 may generate the third control signal CONT3 controlling operations of the gamma reference voltage generator 400 based on the input control signal CONT, and may output the third control signal CONT3 to the gamma reference voltage generator 400.

The gate driver 300 may generate gate signals driving the gate lines in response to the first control signal CONT1 received from the timing controller 200. The gate driver 300 may sequentially output the gate signals to the gate lines.

In some exemplary embodiments of the present inventive concept, the gate driver 300 may be directly disposed on the display panel 100, or may be connected to the display panel 100 in a tape carrier package (TCP) configuration. Alternatively, the gate driver 300 may be disposed on the peripheral region of the display panel 100.

The gamma reference voltage generator 400 may generate a gamma reference voltage VGREF in response to the third control signal CONT3 received from the timing controller 200. The gamma reference voltage generator 400 may output the gamma reference voltage VGREF to the data driver 500. The level of the gamma reference voltage VGREF may correspond to grayscales of a plurality of pixel data included in the data signal DAT.

In some exemplary embodiments of the present inventive concept, the gamma reference voltage generator 400 may be disposed in the timing controller 200, or may be disposed in the data driver 500.

The data driver 500 may receive the second control signal CONT2 and the data signal DAT from the timing controller 200, and may receive the gamma reference voltage VGREF from the gamma reference voltage generator 400. The data driver 500 may convert the data signal DAT to data voltages having analogue levels based on the gamma reference voltage VGREF. The data driver 500 may output the data voltages to the data lines.

In some exemplary embodiments of the present inventive concept, the data driver 500 may be directly disposed on the display panel 100, or may be connected to the display panel 100 in a tape carrier package (TCP) configuration. Alternatively, the data driver 500 may be disposed on the peripheral region of the display panel 100.

The data driver 500 will be described in more detail below with reference to FIG. 4.

Figure 2:
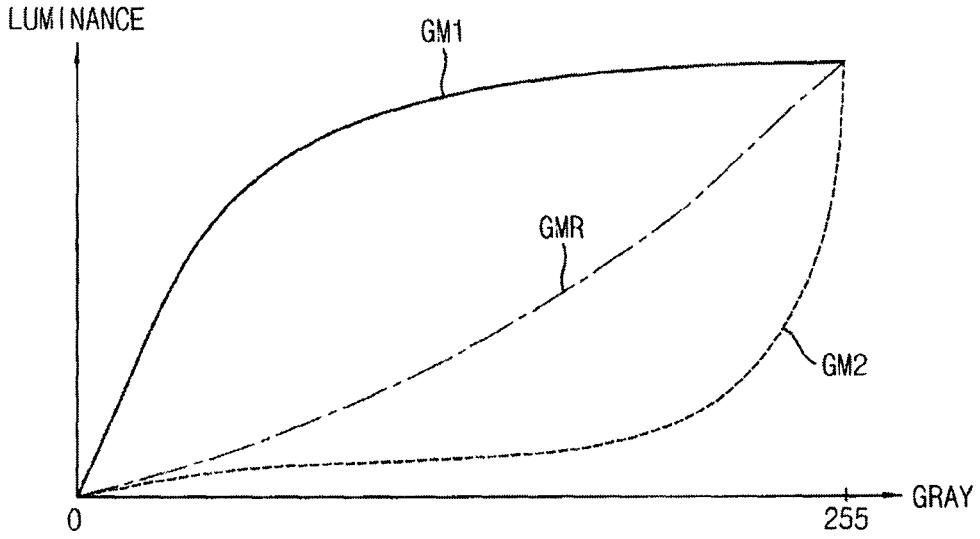
FIG. 2 is a graph illustrating gamma curves used in a display apparatus according to an exemplary embodiment of the present inventive concept.

FIG. 2 is a graph illustrating gamma curves used in a display apparatus according to an exemplary embodiment of the present inventive concept.

Referring to FIGS. 1 and 2, gamma curves may indicate a relationship between a plurality of grayscales of an image and luminance or transmittance of the display panel 100. A reference gamma curve GMR may increase a display quality of the display panel 100. For example, the reference gamma curve GMR may be a gamma curve with a gamma value of about 2.2.

A luminance of an image based on a first gamma curve GM1 may be equal to or higher than a luminance of an image based on the reference gamma curve GMR. A luminance of an image based on a second gamma curve GM2 may be equal to or lower than the luminance of the image based on the reference gamma curve GMR. A composite gamma curve of the first gamma curve GM1 and the second gamma curve GM2 may be substantially the same as the reference gamma curve GMR.

A pixel operating based on the reference gamma curve GMR may display an image having a luminance that is substantially the same as a target luminance. A pixel operating based on the first gamma curve GM1 may display an image having a luminance that is higher than the target luminance. A pixel operating based on the second gamma curve GM2 may display an image having a luminance that is lower than the target luminance. When one of two adjacent pixels operates based on the first gamma curve GM1, and when the other of two adjacent pixels operates based on the second gamma curve GM2, an image having the target luminance may be displayed by two adjacent pixels by combining the image having the lower luminance with the image having the higher luminance.

Figure 3:
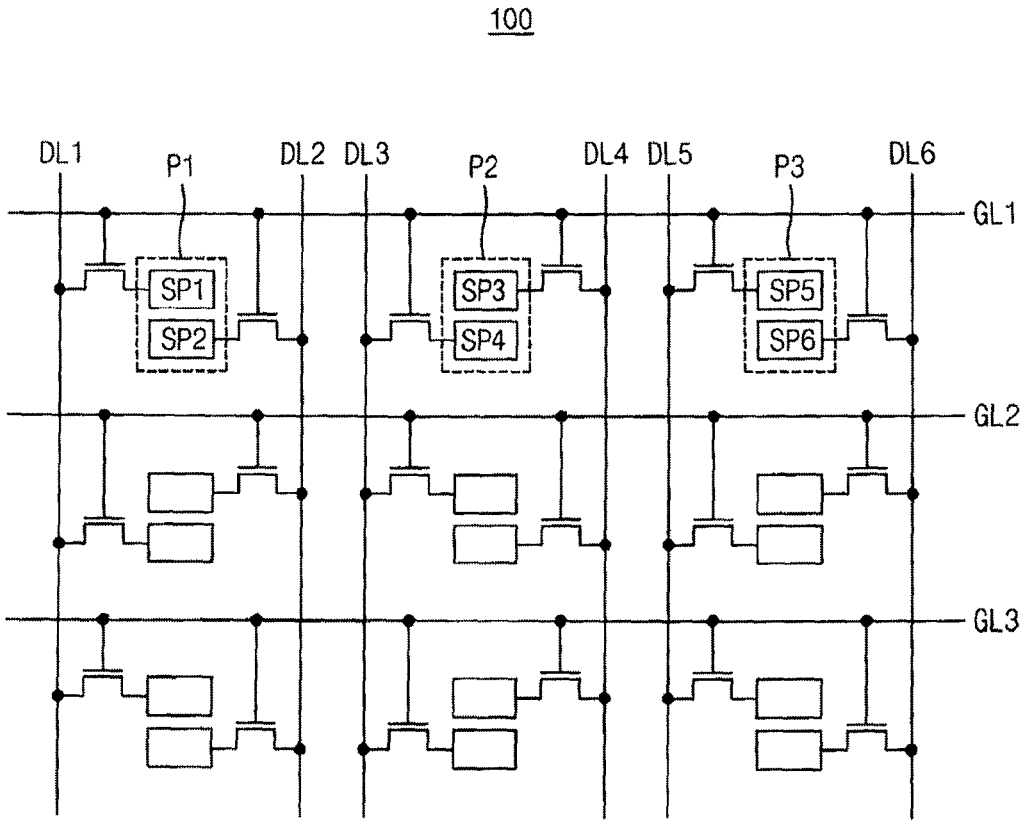
FIG. 3 is a diagram illustrating a display panel included in a display apparatus according to an exemplary embodiment of the present inventive concept.

FIG. 3 is a diagram illustrating a display panel included in a display apparatus according to an exemplary embodiment of the present inventive concept.

Referring to FIGS. 2 and 3, the display panel 100 may include first to third gate lines GL1, GL2, GL3 extending in the first direction D1, first to sixth data lines DL1, DL2, DL3, DL4, DL5, DL6 extending in the second direction D2 crossing the first direction D1 and first to third pixels P1, P2, P3. The first to third gate lines GL1~GL3 may be sequentially arranged along the second direction D2. The first to sixth data lines DL1~DL6 may be sequentially arranged along the first direction D1.

The first pixel P1 may include first and second sub-pixels SP1, SP2. The first sub-pixel SP1 may be connected to the first gate line GL1 and the first data line DL1. The second sub-pixel SP2 may be connected to the first gate line GL1 and the second data line DL2. The first and second sub-pixels SP1, SP2 may be adjacent to each other along the second direction D2. Alternatively, the first and second sub-pixels SP1, SP2 may be adjacent to each other along the first direction D1.

The first pixel P1 may display a first color. The first color may be one of red, green and blue. The first pixel P1 may display a first gray. The first sub-pixel SP1 may display the first gray based on the first gamma curve GM1. When the first sub-pixel SP1 displays the first gray based on the first gamma curve GM1, the second sub-pixel SP2 may display the first gray based on the second gamma curve GM2. Thus, the first pixel P1 may display the first gray based on the reference gamma curve GMR.

The second pixel P2 may include third and fourth sub-pixels SP3, SP4. The third sub-pixel SP3 may be connected to the first gate line GL1 and the fourth data line DL4. The fourth sub-pixel SP4 may be connected to the first gate line GL1 and the third data line DL3. The third and fourth sub-pixels SP3, SP4 may be adjacent to each other along the second direction D2. Alternatively, the third and fourth sub-pixels SP3, SP4 may be adjacent to each other along the first direction D1.

The second pixel P2 may display a second color. The second color may be one of red, green and blue. The second pixel P2 may display a second gray. The third sub-pixel SP3 may display the second gray based on the first gamma curve GM1. When the third sub-pixel SP3 displays the second gray based on the first gamma curve GM1, the fourth sub-pixel SP4 may display the second gray based on the second gamma curve GM2. Thus, the second pixel P2 may display the second gray based on the reference gamma curve GMR.

The third pixel P3 may include fifth and sixth sub-pixels SP5, SP6. The fifth sub-pixel SP5 may be connected to the first gate line GL1 and the fifth data line DL5. The sixth sub-pixel SP6 may be connected to the first gate line GL1 and the sixth data line DL6. The fifth and sixth sub-pixels SP5, SP6 may be adjacent to each other along the second direction D2. Alternatively, the fifth and sixth sub-pixels SP5, SP6 may be adjacent to each other along the first direction D1.

The third pixel P3 may display a third color. The third color may be one of red, green and blue. The third pixel P3 may display a third gray. The fifth sub-pixel SP5 may display the third gray based on the first gamma curve GM1. When the sub-pixel SP5 displays the third gray based on the first gamma curve GM1, the sixth sub-pixel SP6 may display the third gray based on the second gamma curve GM2. Thus, the third pixel P3 may display the third gray based on the reference gamma curve GMR.

Figures 4, 5:
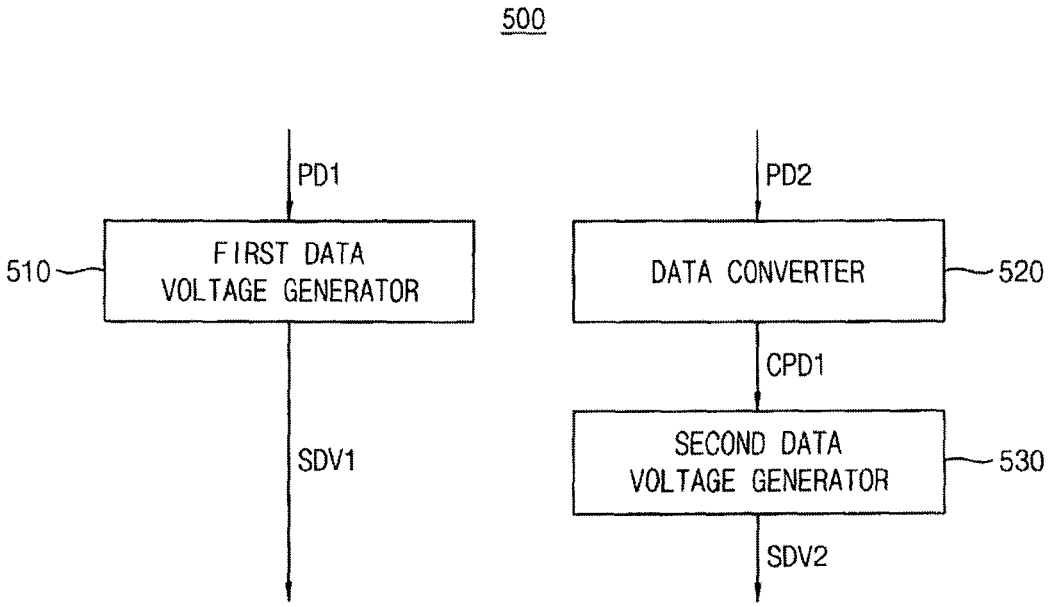
FIG. 4 is a block diagram illustrating a data driver included in a display apparatus according to an exemplary embodiment of the present inventive concept.
FIG. 5 is a table illustrating a look-up table stored in a data driver included in a display apparatus according to an exemplary embodiment of the present inventive concept.

FIG. 4 is a block diagram illustrating a data driver included in a display apparatus according to an exemplary embodiment of the present inventive concept. FIG. 5 is a table illustrating a look-up table stored in a data driver included in a display apparatus according to an exemplary embodiment of the present inventive concept.

Referring to FIGS. 1, 2, 3, 4 and 5, the data driver 500 may include a first data voltage generator 510, a data converter 520 and a second data voltage generator 530.

The data driver 500 may receive the data signal DAT from the timing controller 200. The data signal DAT may include first pixel data PD1 and second pixel data PD2. The first pixel data PD1 and the second pixel data PD2 may be data instructing the first pixel P1 to display the first gray based on the first gamma curve GM1. The first pixel data PD1 may be substantially the same as the second pixel data PD2.

The first data voltage generator 510 may receive the first pixel data PD1. The first data voltage generator 510 may generate a first data voltage SDV1. The first data voltage SDV1 may have an analogue level based on the first pixel data PD1. The first data voltage generator 510 may output the first data voltage SDV1 to the first data line DL1.

The data converter 520 may receive the second pixel data PD2. The data converter 520 may convert the second pixel data PD2 to first converted pixel data CPD1. The first converted pixel data CPD1 may be data instructing the first pixel P1 to display the first gray based on the second gamma curve GM2. The data converter 520 may output the first converted pixel data CPD1 to the second data voltage generator 530.

The data converter 520 may store a look-up table. The data converter 520 may convert the second pixel data PD2 to the first converted pixel data CPD1 by referring to the look-up table.

For example, referring to FIG. 5, the second pixel data PD2 may have a value of 11111111 to display 255 gray based on the first gamma curve GM1. The first converted pixel data CPD1 may have a value of 11111110 to display 255 gray based on the second gamma curve GM2. The data converter 520 may convert the value of 11111111 to the value of 11111110 by referring to the look-up table. The second pixel data PD2 may have a value of 11111110 to display 254 gray based on the first gamma curve GM1. The first converted pixel data CPD1 may have a value of 11111100 to display 254 gray based on the second gamma curve GM2. The data converter 520 may convert the value of 11111110 to the value of 11111100 by referring to the look-up table.

The data converter 520 according to an exemplary embodiment of the present inventive concept may include at least one nonvolatile memory such as an erasable programmable read-only memory (EPROM), an electrically erasable programmable read-only memory (EEPROM), a flash memory, a phase change random access memory (PRAM), a resistance random access memory (RRAM), a magnetic random access memory (MRAM), or a ferroelectric random access memory (FRAM). The look-up table may be stored in the nonvolatile memory. For example, the look-up table may be stored in the nonvolatile memory when manufacturing the display apparatus.

The data converter 520 according to an exemplary embodiment of the present inventive concept may include at least one volatile memory such as a static random access memory (SRAM), or a dynamic random access memory (DRAM). The look-up table received from an external host or the timing controller, and may be stored in the volatile memory. For example, the look-up table may be stored in the volatile memory at the beginning of an operation of the display apparatus.

The second data voltage generator 530 may generate a second data voltage SDV2. The second data voltage SDV2 may have an analogue level based on the first converted pixel data CPD1. The second data voltage generator 530 may output the second data voltage SDV2 to the second data line DL2.

A polarity of the first data voltage SDV1 may be different from a polarity of the second data voltage SDV2. For example, the polarity of the first data voltage SDV1 may be positive with respect to a common voltage, and the polarity of the second data voltage SDV2 may be negative with respect to the common voltage.

The first data line DL1 may be adjacent to the second data line DL2. For example, referring to FIG. 3, the first pixel P1 may be connected to two adjacent data lines DL1, DL2, and two sub-pixels SP1, SP2 included in the first pixel P1 may be connected to two data lines DL1, DL2, respectively.

Referring to FIGS. 3 and 4, for example, data voltages SDV1, SDV2 may be output to two data lines DL1, DL2. However, according to exemplary embodiments of the present inventive concept, data voltages may be output to 2*n data lines, where n is a natural number equal to or greater than 2. For example, n data lines, such as odd-numbered data lines, may be connected to a data voltage generator, and the other n data lines, such as even-numbered data lines, may be connected to a data converter and a data voltage generator. The data converter may be shared by two data lines.

The data driver according to exemplary embodiments of the present inventive concept may include a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, or a printer.

While the present inventive concept has been shown and described with reference to the exemplary embodiments thereof, it will be apparent to those of ordinary skill in the art that various changes in form and detail may be made thereto without departing from the spirit and scope of the present inventive concept.

What is claimed is:

1. A data driver comprising:

a first data voltage generator configured to generate a first data voltage having analog form based on first pixel data having a digital form and configured to output the first data voltage to a first data line, the first pixel data being generated based on a first gamma curve;

a data converter configured to convert second pixel data having the digital form to first converted pixel data having the digital form based on a look-up table, the second pixel data being generated based on the first gamma curve, the look-up table indicating a mapping of pixel data according to the first gamma curve to converted pixel data according to a second gamma curve different from the first gamma curve; and a second data voltage generator configured to generate a second data voltage having the analog form based on the first converted pixel data and configured to output the second data voltage to a second data line.

2. The data driver of claim 1, wherein the second pixel data is greater than the first converted pixel data.

3. The data driver of claim 1, wherein the first pixel data is substantially the same as the second pixel data.

4. The data driver of claim 1, wherein a polarity of the first data voltage is different from a polarity of the second data voltage.

5. The data driver of claim 1, wherein the first data line is adjacent to the second data line.

6. The data driver of claim 1, wherein a composite gamma curve of the first and second gamma curves is substantially the same as a reference gamma curve, and wherein a luminance of an image based on the first gamma curve is equal to or higher than a luminance of an image based on the reference gamma curve, and a luminance of an image based on the second gamma curve is equal to or lower than the luminance of the image based on the reference gamma curve.

7. A display apparatus comprising:

a display panel comprising a first gate line extending in a first direction, first and second data lines extending in a second direction, and a first pixel connected to the first gate line and the first and second data lines, the second direction crossing the first direction;

a timing controller configured to generate first and second pixel data having a digital form based on input image data and a first gamma curve; and a data driver configured to generate a first data voltage having an analog form based on the first pixel data to output the first data voltage to the first data line, configured to convert the second pixel data to first converted pixel data having the digital form based on a look-up table, and configured to generate a second data voltage having the analog form based on the first converted pixel data to output the second data voltage to the second data line, the look-up table indicating a mapping of pixel data according to the first gamma curve to converted pixel data according to a second gamma curve different from the first gamma curve.

8. The display apparatus of claim 7, wherein the first pixel comprises a first sub-pixel connected to the first gate line and the first data line and a second sub-pixel connected to the first gate line and the second data line.

9. The display apparatus of claim 8, wherein the first sub-pixel is configured to display substantially the same color as the second sub-pixel.

10. The display apparatus of claim 7, wherein the second pixel data is greater than the first converted pixel data.

11. The display apparatus of claim 7, wherein the first pixel data is substantially the same as the second pixel data.

12. The display apparatus of claim 7, wherein a polarity of the first data voltage is different from a polarity of the second data voltage.

13. The display apparatus of claim 7, wherein the first data line is adjacent to the second data line.

14. The display apparatus of claim 7, wherein a composite gamma curve of the first and second gamma curves is substantially the same as a reference gamma curve, and a luminance of an image based on the first gamma curve is equal to or higher than a luminance of an image based on the reference gamma curve, and a luminance of an image based on the second gamma curve is equal to or lower than the luminance of the image based on the reference gamma curve.

15. A method of driving a display apparatus, the method comprising:

generating first and second pixel data having a digital form based on input image data and a first gamma curve;

generating a first data voltage having an analog form based on the first pixel data to output the first data voltage to a first data line;

converting the second pixel data to first converted pixel data, having the digital form based on a look-up table, the look-up table indicating a mapping of pixel data according to the first gamma curve to converted pixel data according to a second gamma curve different from the first gamma curve; and generating a second data voltage having the analog form based on the first converted pixel data to output the second data voltage to a second data line.

16. The method of claim 15, wherein the display apparatus comprises a display panel comprising a first gate line extending in a first direction, the first and second data lines extending in a second direction, and a first pixel connected to the first gate line and the first and second data lines, the second direction crossing the first direction.

17. The method of claim 16, wherein the first pixel comprises a first sub-pixel connected to the first gate line and the first data line and a second sub-pixel connected to the first gate line and the second data line.

18. The method of claim 15, wherein the second pixel data is greater than the first converted pixel data.

19. The method of claim 15, wherein the first pixel data is substantially the same as the second pixel data.

20. The method of claim 15, wherein a composite gamma curve of the first and second gamma curves is substantially the same as a reference gamma curve, and a luminance of an image based on the first gamma curve is equal to or higher than a luminance of an image based on the reference gamma curve, and a luminance of an image based on the second gamma curve is equal to or lower than the luminance of the image based on the reference gamma curve.

* * * * *